US007605690B2

(12) United States Patent
Schroeder-Bodenstein

(10) Patent No.: US 7,605,690 B2
(45) Date of Patent: Oct. 20, 2009

(54) RAIL VEHICLE WITH SENSING OF THROWN UP BALLAST

(75) Inventor: Kaspar Schroeder-Bodenstein, Düsseldorf (DE)

(73) Assignee: Siemens Aktiengesellschaft, Munich (DE)

( * ) Notice: Subject to any disclaimer, the term of this patent is extended or adjusted under 35 U.S.C. 154(b) by 301 days.

(21) Appl. No.: 11/808,836

(22) Filed: Jun. 13, 2007

(65) Prior Publication Data

US 2007/0296561 A1 Dec. 27, 2007

(30) Foreign Application Priority Data

Jun. 14, 2006 (DE) ..... 10 2006 028 004

(51) Int. Cl.

| | |
|---|---|
| ***B60Q 1/00*** | (2006.01) |
| ***B60R 25/10*** | (2006.01) |
| ***G08B 21/00*** | (2006.01) |
| ***B61L 23/04*** | (2006.01) |
| ***B61L 23/34*** | (2006.01) |
| ***E01B 29/05*** | (2006.01) |
| ***E01B 21/00*** | (2006.01) |

(52) U.S. Cl. ..... 340/426.16; 340/425.5; 340/426.1; 340/436; 340/438; 340/665; 246/120; 246/121; 246/122 R; 104/2; 104/18; 238/2; 238/9

(58) Field of Classification Search ..... 340/425.5, 340/426.16, 436, 438, 665; 246/120, 121, 246/122 R; 238/2, 18; 104/2, 9
See application file for complete search history.

(56) References Cited

U.S. PATENT DOCUMENTS 2,944,250 A * 7/1960 Outt ..... 73/432.1
4,073,193 A * 2/1978 Mastandrea ..... 73/865.5

(Continued)

FOREIGN PATENT DOCUMENTS

DE 19826220 12/1999

(Continued)

OTHER PUBLICATIONS

S.J. Cawser, Aej Hardy, Ce Wright: "AEATR-PCE-2002-RR-005 Issue 1—Feasibility of detecting rail flaws using acoustic equipment fitted to vehicles—Acoustic Track Monitoring; Phase 1: Initial Data Gathering and Analysis" (Online), Seiten 1-27, XP002455011, May 23, 2005, Rail Safety and Standards; Others; 2005; Board, gefunden im Internet: URL:http://www.rssb.co.uk/pdf/reports/Research/Feasibility%20of%20detecting%20rail%20flaws%2Ousing%20acoustic%20equipment%20fitted%20to20vehicle.pdf (gefunden am Oct. 15, 2007).

(Continued)

*Primary Examiner*—Benjamin C Lee
*Assistant Examiner*—Lam P Pham
(74) *Attorney, Agent, or Firm*—Harness, Dickey & Pierce, P.L.C.

(57) ABSTRACT

A rail vehicle includes an underbody which is subjected to thrown up ballast when the rail vehicle is operating on a ballasted section of track. In at least one embodiment, the underbody is equipped with at least one acoustic signal pickup which acoustically senses ballast stones striking the underbody; a signal processing device is provided to which a signal is fed from the at least one acoustic signal pickup and which processes the signal in such a way that a thrown up ballast signal is generated which represents the impacting of ballast stones on the underbody; and the thrown up ballast signal from the signal processing device is included in a mode of operation of the rail vehicle.

19 Claims, 1 Drawing Sheet

U.S. PATENT DOCUMENTS 6,216,985 B1 * 4/2001 Stephens ..... 246/120

FOREIGN PATENT DOCUMENTS

DE 102004041090 3/2006
WO 2006/021050 3/2006
WO 2006/021514 3/2006

OTHER PUBLICATIONS

European Search Report dated Oct. 30, 2007, issued in corresponding European Application No. 07 10 9310.

* cited by examiner

RAIL VEHICLE WITH SENSING OF THROWN UP BALLAST

PRIORITY STATEMENT

The present application hereby claims priority under 35 U.S.C. §119 on German patent application number DE 10 2006 028 004.0 filed Jun. 14, 2006, the entire contents of which is hereby incorporated herein by reference.

FIELD

Embodiments of the invention generally relate to a rail vehicle. For example, they may relate to one having an underbody which is subjected to thrown up ballast when the rail vehicle is operating on a ballasted section of track.

BACKGROUND

Rail vehicles can cause ballast to be thrown up as they travel on a ballasted section of track. In particular, in this context, stones can be carried out of the ballast bed as a result of, for example, air forces from the slipstream or else due to accumulations of ice dropping down in the winter. If these ballast stones have a sufficient height they mainly strike the underbody of the rail vehicle and strike the underbody and the parts of the vehicle underneath it, causing damage thereto. Since the ballast stone strikes generally occur only in the rear part of the rail vehicle and on the underside they are not noticed by the train driver.

SUMMARY

In at least one embodiment of the invention, a rail vehicle is developed in such a way that it is possible to allow for ballast being thrown up when the rail vehicle travels.

In at least one embodiment, the underbody is equipped with at least one acoustic signal pickup which acoustically senses ballast stones striking the underbody, a signal processing device is provided to which a signal is fed from the at least one acoustic signal pickup and which processes the signal in such a way that a thrown up ballast signal is generated which represents the impacting of ballast stones on the underbody, and the thrown up ballast signal from the signal processing device is included in a mode of operation of the rail vehicle.

Thrown up ballast is therefore sensed using at least one acoustic signal pickup so that soundwaves which are generated when a ballast stone strikes the underbody of the rail vehicle are sensed. Maximum values of the intensity of the signal from the at least one acoustic signal pickup for specific frequency ranges can then be considered to be representative of this striking of a ballast stone on the underbody.

In the following description, any component on a bottom side of the rail vehicle is understood to be an underbody of the rail vehicle. To a certain extent, the underbody is therefore formed by components which are arranged under the floor, such as electrical assemblies or else the bogies which also have to be protected against thrown up ballast.

The signal processing device is used to evaluate the signal which is generated by the signal pickup, specifically in such a way that the signal represents the impacting of ballast stones on the underbody.

The signal processing device preferably processes the signal from the at least one acoustic signal pickup in such a way that it detects individual ballast stone strikes, counts the ballast stone strikes, and an acquired number of ballast stone strikes per time unit is included in the thrown up ballast signal. To this extent, the thrown up ballast signal can signal a frequency of ballast stone strikes.

The signal processing device can evaluate the thrown up ballast signal with respect to the exceeding of a predetermined safety level, and when the safety level is exceeded it can output a warning signal. The safety level can be tuned here in such a way that reduction in the speed of the vehicle due to the throwing up of ballast appears appropriate. The warning signal can then be implemented by a train driver of the rail vehicle in such a way that the speed of the vehicle is reduced to a value at which the throwing up of ballast is sufficiently reduced.

The warning signal can also be directed to a central train control system which, if appropriate, automatically causes the speed to be reduced or said warning signal can be fed to a control center at the infrastructure end. The signaling to the control center could then take place by way of a wire-free communications connection from the rail vehicle to the remote control center.

So that the signal from the at least one signal pickup can be reduced to the central signal components for the sensing of ballast stone strikes it is preferred if it includes electronic components for bandpass filtering, squaring of signals and forming of sliding sums.

Favorable data processing is obtained if the signal processing device operates digitally and by scanning the signal from the signal pickup in a signal processor.

The number of ballast stones striking the underbody can be calculated with respect to one or more predetermined time intervals. These time intervals are to be selected in such a way that a representative statement about the impacting of ballast stone strike on the underbody is obtained.

It is also possible for individual sensed ballast stones to be indicated acoustically by way of a warning signal. In this case, for example an acoustic impression of the thrown up ballast situation on the underbody of the rail vehicle is communicated to a train driver in a flexible fashion.

The thrown up ballast signal can also be displayed visually, which provides increased transparency for the train driver, for example.

In order to standardize the signal processing device or for the purpose of self-testing of the system it is favorable if a signal transmitter which is designed to generate the noise of a ballast stone striking on the underbody is arranged in the vicinity of the at least one acoustic signal pickup. On this basis it is possible for the signal processing device, in particular its electronic components such as the bandpass filtering device, to be configured in such a way that signal components which are not required and which are not related to the striking of a ballast stone are effectively suppressed.

The at least one signal pickup can be formed by a sound microphone which is, if appropriate, to be protected itself against ballast stone strikes.

A multiplicity of signal pickups is preferably arranged distributed over the underbody of the rail vehicle and is connected to the signal processing device which processes the multiplicity of signals of the signal pickups. In this embodiment of the invention, the thrown up ballast signal is generated on the basis of the multiplicity of signals from the various signal pickups.

The signal pickup can also be an acceleration pickup which is connected to the structure of the rail vehicle and senses the solid-borne sound signals.

The embodiments of the invention presented above provide the advantage that, for example, information about striking ballast stones is fed to the train driver, the control center or the train control system. On the basis of this information it is possible, for example when there is lying snow in the winter, to carry out immediate temporary reduction of the travel speed and thus avoid further damage. Compared to alternative, general preventive speed reductions when there is lying snow, which are otherwise customary in this situation, the necessary operating restrictions of the rail vehicle can thus be significantly loosened. A decrease in speed has to take place, for example, only if an excessive degree of flying ballast is detected using the arrangement which is presented.

A further application possibility of at least one embodiment of the invention is, in particular in the case of high speed trains, to detect sections of track with a high tendency to thrown up ballast. On a case by case basis it is then possible to reduce the admissible travel speed until a respective section of track is repaired again.

BRIEF DESCRIPTION OF THE DRAWINGS

Example embodiments of the invention will also be described in more detail below with reference to the drawings, in which.

DETAILED DESCRIPTION OF THE EXAMPLE EMBODIMENTS

Figure 1:
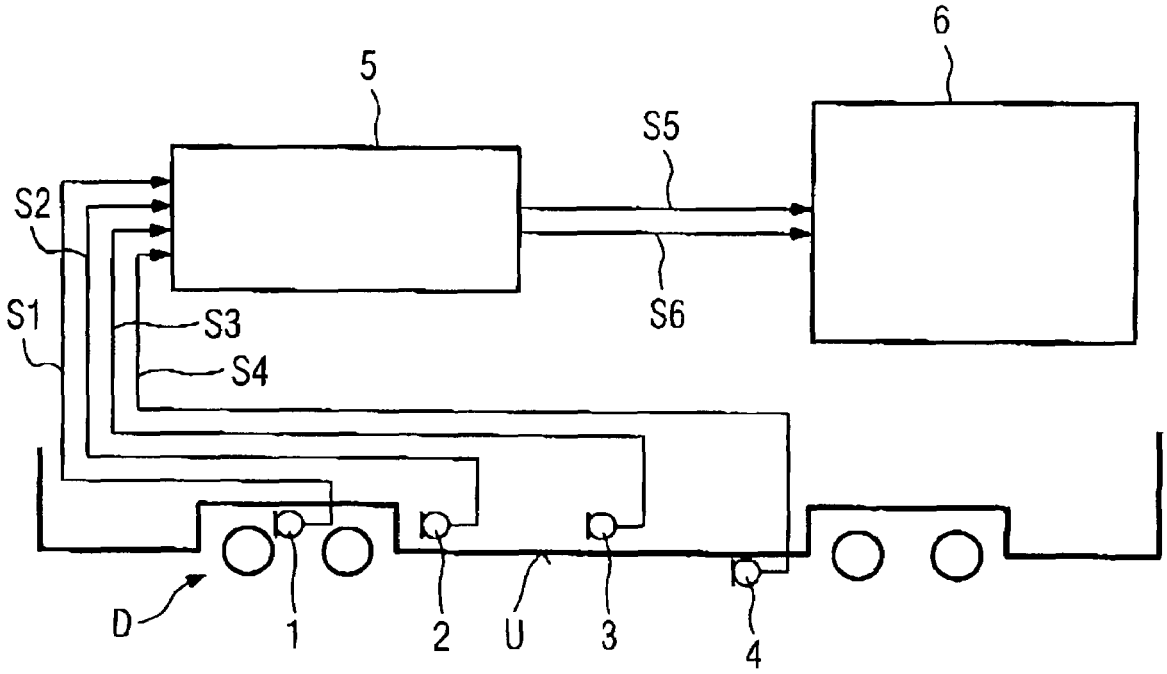
FIG. 1 is a schematic illustration of an overall arrangement for sensing and signaling thrown up ballast in a rail vehicle.

The terminology used herein is for the purpose of describing particular embodiments only and is not intended to be limiting of the present invention. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

In describing example embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referencing the drawings, wherein like reference numerals designate identical or corresponding parts throughout the several views, example embodiments of the present patent application are hereafter described. Like numbers refer to like elements throughout. As used herein, the terms "and/or" and "at least one of" include any and all combinations of one or more of the associated listed items.

As is apparent from FIG. 1, an overall arrangement for sensing and signaling thrown up ballast in a rail vehicle includes, in the present example embodiment, a total of four acoustic signal pickups 1, 2, 3, 4 which are embodied as sound microphones. The first signal pickup 1 is arranged in the region of a bogey D in the underbody region. The signal pickups 2, 3 are located on the outside of the underbody region or above the underbody, which is affected particularly by impacting of thrown up ballast. The fourth signal pickup 4 is mounted directly adjacent to a bogey region on an underside of the rail vehicle.

Each of the signal pickups 1, 2, 3, 4 senses soundwaves from an associated sensing range. When ballast is thrown up, individual ballast stones, which are thrown up as a result of a slipstream or due to accumulations of ice dropping down in the winter, generate soundwaves as the result of the impacting on the underbody U, and said soundwaves are sensed by the signal pickups 1, 2, 3, 4 and converted into electrical signals S1, S2, S3, S4. In one particularly simple embodiment, it is also possible to provide just a single signal pickup which then of course has a restricted sensing range for the impacting of ballast stones.

The four signals S1, . . . , S4 are fed to a signal processing device 5 which includes electronic components for bandpass filtering, squaring of signals and forming of sliding sums. The signal processing device 5 operates digitally and scans the individual signals S1, . . . , 4 using a signal processor.

Figure 2:
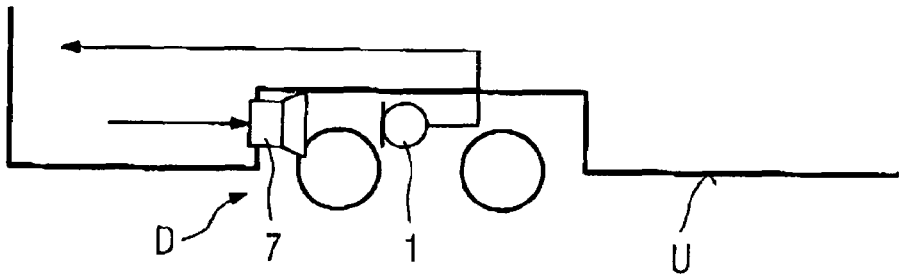
FIG. 2 is a schematic illustration of a bogey region of a rail vehicle.

In order to standardize the signal processing device or for the purpose of self-testing, a signal transmitter 7 is used (cf. FIG. 2) which is designed to emit acoustic signals which represent ballast stones impacting against the underbody U. In this way the signal processing device 5 can be adjusted in such a way that suitable filtering of the signals S1, . . . , S4 can take place. The reliable detection of impacting ballast stones accompanied by the suppression of interference signals is promoted by this.

The signal processing device 5 generates a thrown up ballast signal S5 from the signals S1, . . . , S4, specifically on the following basis: for the individual signals S1, . . . , S4, the number of impacting ballast stones detected is respectively counted over one or more predetermined time intervals. The thrown up ballast signal S5 then represents a frequency of impacting ballast stones, and thus a measure for the impacting of thrown up ballast against the underbody of the rail vehicle.

Alternatively, the signal processing device 5 can also be restricted in its function to carrying out just one ballast stone detection for the individual signals S1, . . . , S4. In this case, it is characteristic of the thrown up ballast signal S5 that it represents a superimposition of four signals which each represent ballast stone strikes on the underbody as a function of time.

The thrown up ballast signal S5 is fed to a monitoring device 6 which can be arranged in the region where a train driver is accommodated in the rail vehicle. In this case, the thrown up ballast signal S5 can be indicated to the train driver acoustically or else with the aid of a visual display, for information purposes. The train driver can then react to increased thrown up ballast by, for example, reducing the speed of the rail vehicle.

As an alternative to this, the monitoring device 6 can also be a component of a central train control system which automatically brings about a reduction in speed of the rail vehicle when too much ballast is being thrown up. As a further alternative it is conceivable for the thrown up ballast signal S5 to be transmitted to a remote control center at which the monitoring device 6 is also arranged. This can be done, for example, using a wire-free communications connection between the rail vehicle and the control center.

The signal processing device 5 can be configured in such a way that when a predetermined signal level for the thrown up ballast signal S5 is exceeded if it is related to time intervals, it outputs a warning signal S6 to the monitoring device 6. The signal level is then to be selected in such a way that the exceeding of said level brings about a reduction in speed. It is likewise possible to define a lower signal level at which an increase in speed of the rail vehicle can take place since the throwing up of ballast which has taken place previously is no longer occurring.

Further, elements and/or features of different example embodiments may be combined with each other and/or substituted for each other within the scope of this disclosure and appended claims.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A rail vehicle, comprising:

an underbody, subjectable to thrown up ballast when the rail vehicle is operating on a ballasted section of track, the underbody including at least one acoustic signal pickup, to acoustically sense ballast stones striking the underbody;

a signal processing device to receive a signal from the at least one acoustic signal pickup and to process the signal such that a thrown up ballast signal is generated which represents the impacting of ballast stones on the underbody, the thrown up ballast signal from the signal processing device being included in a mode of operation of the rail vehicle.

2. The rail vehicle as claimed in claim 1, wherein the signal processing device is used to process the signal of the at least one acoustic signal pickup to detect individual ballast stone strikes and to count the ballast stone strikes, and wherein an acquired number of ballast stone strikes per time unit is included in the thrown up ballast signal.

3. The rail vehicle as claimed in claim 1, wherein the signal processing device is used to evaluate the thrown up ballast signal with respect to the exceeding of a predetermined safety level, and wherein, when the safety level is exceeded, a warning signal is output.

4. The rail vehicle as claimed in claim 3, wherein the warning signal is feedable to at least one of a train driver of the rail vehicle, a train control system and a control center at the infrastructure end.

5. The rail vehicle as claimed in claim 1, wherein the signal processing device contains electronic components for bandpass filtering, squaring signals and forming sliding sums.

6. The rail vehicle as claimed in claim 1, wherein the signal processing device is able to operate digitally and by scanning the signal from the at least one signal pickup in a signal processor.

7. The rail vehicle as claimed in claim 1, wherein the number of ballast stones which strike the underbody is calculated with respect to one or more predetermined time intervals.

8. The rail vehicle as claimed in claim 1, wherein individual sensed ballast stones are indicated acoustically by way of a warning signal.

9. The rail vehicle as claimed in claim 1, wherein the thrown up ballast signal is displayed visually.

10. The rail vehicle as claimed in claim 1, further comprising:

a signal transmitter to generate the noise of a ballast stone striking the underbody, arranged in the vicinity of the at least one acoustic signal pickup.

11. The rail vehicle as claimed in claim 1, wherein the at least one signal pickup is formed by a sound microphone.

12. The rail vehicle as claimed in claim 1, wherein the at least one signal pickup is an acceleration pickup which is connected to the rail vehicle structure.

13. The rail vehicle as claimed in claim 1, wherein a multiplicity of signal pickups are arranged distributed over the underbody of the rail vehicle and connected to the signal processing device, to processes the multiplicity of signals of the signal pickups.

14. The rail vehicle as claimed in claim 2, wherein the signal processing device is used to evaluate the thrown up ballast signal with respect to the exceeding of a predetermined safety level, and wherein, when the safety level is exceeded, a warning signal is output.

15. The rail vehicle as claimed in claim 14, wherein the warning signal is feedable to at least one of a train driver of the rail vehicle, a train control system and a control center at the infrastructure end.

16. The rail vehicle as claimed in claim 2, wherein the signal processing device contains electronic components for bandpass filtering, squaring signals and forming sliding sums.

17. The rail vehicle as claimed in claim 2, wherein the signal processing device is able to operate digitally and by scanning the signal from the at least one signal pickup in a signal processor.

18. The rail vehicle as claimed in claim 2, wherein the number of ballast stones which strike the underbody is calculated with respect to one or more predetermined time intervals.

19. The rail vehicle as claimed in claim 2, wherein individual sensed ballast stones are indicated acoustically by way of a warning signal.

* * * * *